US007605114B2

(12) United States Patent
Rushlow et al.

(10) Patent No.: US 7,605,114 B2
(45) Date of Patent: Oct. 20, 2009

(54) MULTI-PURPOSE CLEANER COMPRISING BLUE IRON POWDER

(76) Inventors: Claudia Rushlow, 19620 Parker, Livonia, MI (US) 48152; Adriana Liberatore, 7030 Commerce Rd., West Bloomfield, MI (US) 48324

( * ) Notice: Subject to any disclaimer, the term of this patent is extended or adjusted under 35 U.S.C. 154(b) by 611 days.

(21) Appl. No.: 11/416,728

(22) Filed: May 3, 2006

(65) Prior Publication Data

US 2006/0252661 A1 Nov. 9, 2006

Related U.S. Application Data

(60) Provisional application No. 60/677,048, filed on May 3, 2005.

(51) Int. Cl.
*C11D 17/00* (2006.01)

(52) U.S. Cl. ..... 510/238; 510/239; 510/240

(58) Field of Classification Search ..... None
See application file for complete search history.

(56) References Cited

U.S. PATENT DOCUMENTS

| | | | | |
|---|---|---|---|---|
| 3,687,880 | A | 8/1972 | Slegrist | |
| 3,976,581 | A * | 8/1976 | Rose | 510/521 |
| 4,501,680 | A | 2/1985 | Aszman et al. | |
| 5,573,710 | A | 11/1996 | McDonell | |
| 5,719,114 | A | 2/1998 | Zocchi et al. | |
| 6,984,269 | B2 | 1/2006 | Motson et al. | |

FOREIGN PATENT DOCUMENTS

| | | |
|---|---|---|
| EP | 0336878 | 10/1989 |
| JP | 6146036 | 5/1994 |
| JP | 2003183698 | 7/2003 |

* cited by examiner

*Primary Examiner*—Necholus Ogden, Jr.
(74) *Attorney, Agent, or Firm*—Gifford, Krass, Sprinkle, Anderson & Citkowski, P.C.

(57) ABSTRACT

A liquid cleaning solution and associated method for preparing including a composition of Boric Acid, Sodium Chloride, Phosphoric Acid and water. The liquid cleaning solution further includes the provision of a whitening agent. The Phosphoric Acid is present according to a range of between 7-10% by weight of the solution. The whitening agent further may include a bluing agent including a fine blue iron powder suspended colloidally in a water solution and including at least one of a pH balancer and a biocide agent.

2 Claims, No Drawings

MULTI-PURPOSE CLEANER COMPRISING BLUE IRON POWDER

CROSS REFERENCE TO RELATED APPLICATIONS

The present application claims the priority of U.S. Provisional Patent Application Ser. No. 60/677,048, filed May 3, 2005, for a Multi-Purpose Cleaner.

BACKGROUND OF THE INVENTION

1. Field of the Invention

The present invention relates generally to cleaning solutions. More specifically, the present invention discloses a multi-purpose liquid cleaning solution and method for preparing, applicable to material surfaces such as grout, chrome, brass, stainless steel, and which is an improvement over prior art cleaning solutions.

2. Description of the Prior Art

The prior art is well documented with examples of surface detergents and cleaners, including in particular such as ceramic, fiberglass or metallic surfaces. The objective in each instance is to provide for the removal of residual dirt/soils or other impurities.

A first example selected from the prior art includes Japanese Abstract No. 6146036, disclosing a metal surface detergent (e.g. iron, copper, aluminum, brass, and stainless steel) having degreasing and rust inhibiting characteristics and including the mixing of specific acids and chelate agent to and with an aqueous solution of specific polysaccharides. The liquid preparation includes the mixing of inorganic acids, such as hydrochloric acid, sulfuric acid and phosphoric acid or organic acids such as oxalic acid and sulfuric acid, the form of an aqueous solution of 5% to 15% at 5 to 30 parts per weight, and further in terms of pure content per 1 part weight of polysaccharides to the aqueous solutions. The polysaccharides further consist of beta-1, 3-glucan produced by microorganisms belonging to the genus *Auerovacidium*, and the chelate agents such as 1, 2-cyclohexane diamine tetra-acetic acid, further in the form of an aqueous solution of 0.1 to 5%, at greater or equal to ten (10) parts per weight ratio to the total content.

Japanese Abstract No. 2003/183698 teaches a detergent composition for a bathroom, exhibiting excellent detergent effects on plastics including fiber-reinforced plastics, tile, stainless steel, enamel, ceramics, glass and the like. The composition contains at least a surfactant, a chelating agent, a macromolecular compound, a solvent, and a perfume. A concrete example of the chelating agent is a metal ion-mounting agent or a salt thereof. The metal ion-sequestering agent is exemplified by organic carboxylic acids, aminocarboxylic acids, phosphoric acids, phosphonocarboxylic acids and phosphoric acids.

A further reference of note is set forth in European Patent Application No. 0 336 878, to Colgate-Palmolive, and which teaches an acidic aqueous cleaner, preferably in micro-emulsion form, and which exhibits a pH in the range of one to four, and is useful for cleaning hard surfaced items such as bathtubs, sinks, tiles and porcelains, even when some such items are not acidic resistant, e.g. European enamel. A synthetic organic detergent includes a mixture anionic and non-ionic detergents (e.g. sodium paraffin sulfonate), higher fatty alcohol ethoxylate sulfate and high fatty alcohol or phenol ethoxylate, carboxylic acid, and phosphoric acid in an aqueous medium.

SUMMARY OF THE PRESENT INVENTION

A liquid cleaning solution and associated method for producing including a composition of Boric Acid, Sodium Chloride, Phosphoric Acid and water. The liquid cleaning solution further includes the provision of a whitening agent.

The Phosphoric Acid is present according to a range of between 7-10% by weight of the solution. The whitening agent further may include a bluing agent including a fine blue iron powder suspended colloidally in a water solution and including at least one of a pH balancer and a biocide agent.

The method includes the steps of adding to a base water solution a first volume of a Boric Acid, adding an additional amount of Sodium Chloride to the solution as well as a further amount of a Phosphoric Acid. Additional steps include adding a whitening agent, as well as the Phosphoric Acid in a range of between 7-10% by weight of the overall solution. The cleaning solution is further supplied as a fine mist spray.

DESCRIPTION OF THE PREFERRED EMBODIMENTS

The present invention teaches a spray applied cleaning solution capable of instantly removing set-in stains, mop water buildup and hardened dirt from grout existing in ceramic tiles. Additionally, the present invention teaches a cleaning solution capable of being applied to any surface for removing all built up residual dirt/soils or impurities, thereby restoring the surface to its pre-soil condition.

In a first preferred embodiment, a recipe and corresponding sequence for mixing the cleaning solution includes a 25 gram amount of diluted Boric Acid ($H_3BO_3$) dissolved in a volume of water at a temperature range of ideally 170° F.-180° F. The Boric Acid is applied to the recipe solution in a first step, otherwise it does not dilute well with Phosphoric Acid (or other acidic components) as will be described and does not give the desired consistency, resulting in a less effective solution.

Added to the Boric Acid solution is an amount, such as 25 grams in a preferred application, of ground (typically crushed/powderized) Salt (Sodium Chloride), and such as is commercially referenced by CAS #7647-145, and which is shortly added to the solution. After letting stand for five (5) minutes, an additional amount of Phosphoric Acid ($H_3PO_4$), such as 46 grams, is added.

The Phosphoric Acid is identified such as by commercial reference CAS #7664-38-2. Finally, a small amount of a whitening agent is provided, typically in liquid form. This is typically also commercially known as a bluing agent in that, by adding microscopic blue particles to the solution, it creates the optical effect of "whitening" the solution. The bluing agent is constructed of a very fine blue iron powder colloidally suspended in water, with the further addition of a pH balancer and a biocide (algae/bacteria preventative).

By weight percentage, a recipe of ingredients according to the present invention are provided as follows:

| | |
|---|---|
| 0.7857 | Tap Water |
| 0.1026 | $H_3PO_4$ Phosphoric Acid |
| 0.0558 | Sodium Chloride |
| 0.0558 | $H_3BO_3$ Boric Acid |
| 0.0021 | Whitening Agent |

It is again understood that the percentages indicated above represent one of a number of different possible ranges, these capable of being adjusted to varying effectiveness and based upon the desired application. It has further been found that the percentage by volume of the Phosphorus is adjusted to varying applications, an effective overall application being 8.7% by volume. A minimal percentage of Phosphorus, ranging downwards to 7.8%, has been found to work effectively, but a minimum of 8% has been found to be necessary for most restoration (initial clean) applications. At an upper end, a percentage of 9.5% of Phosphorus works best, but does not meet Michigan DNR regulations.

By operation, the Boric Acid (also known as Boracic Acid) acts as a mild antiseptic/disinfectant and assists in eliminating the residual film otherwise left by the application of the Phosphoric Acid and Sodium Chloride and in order to remove/break down film residue. The Boric Acid is typically provided as a white crystalline compound exhibiting the properties of a weak acid used as a mild antiseptic inhibiting the action of microorganisms and in the manufacture of cements, enamels and the like.

The Phosphorus is used as a reagent, i.e., a substance which converts one material substance to another by means of the reaction caused thereby, and to extract dirt. As stated previously, the bluing agent adds a cosmetic whitening effect to the mixture. The Sodium Chloride concurrently works as an oxidizing agent for removing rust.

According to the present invention, the cleaning solution is preferably mixed up as a liquid and provided in a spray-issued fashion. Equipment used in the creation of the cleaning solution includes such as a gram scale, graduated (volume holding) cylinders, both metric and standard measuring cups, stirring wand, thermometer (to gauge water temperature) and medicinal droppers. Other equipment utilized includes a suitable spray bottle, grout brush, soft bristle brush, fingertip sprayer with 7" tube, trigger sprayer (a fine mist sprayer best allows for maximum coverage area of the product with minimal waste), storage pails, terrycloth covered sponge to fully remove the dissolved soil.

The preferred applications of the cleaning solution include grout, floor and wall tiles (ceramic) and, as an additional application, stainless steel. Additional applications include soap scum, Formica floorings, bathtubs and shower stalls, glass and plastic shower doors, carpet and upholstery stain removal, appliances, brass, chrome, bathroom and kitchen fixtures, and toilets and sinks. Ideal restoration applications are again to grout, chrome, brass and stainless steel and additional removal applications for mineral deposits, hard water stains, iron, soil stains, soap scum and rust. The present cleaning solution is further odorless in application, although it is advised that among other things, a mask and proper ventilation are recommended during production of the present cleaning solution.

Having described our invention, other and additional preferred embodiments will become apparent to those skilled in the art to which it pertains, and without deviating from the scope of the appended claims.

We claim:

1. A liquid cleaning solution, comprising:

Boric Acid, Sodium Chloride, Phosphoric Acid and water; and a whitening agent further comprising a bluing agent including a fine blue iron powder suspended colloidally in a water solution and including at least one of a pH balancer and a biocide agent.

2. The liquid cleaning solution as described in claim 1, said Phosphoric Acid further comprising a range of between 7-10% by weight of said solution.

* * * * *

UNITED STATES PATENT AND TRADEMARK OFFICE

CERTIFICATE OF CORRECTION

PATENT NO. : 7,605,114 B2
APPLICATION NO. : 11/416728
DATED : October 20, 2009
INVENTOR(S) : Rushlow et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 781 days.

Signed and Sealed this

Fifth Day of October, 2010

David J. Kappos

David J. Kappos
*Director of the United States Patent and Trademark Office*